US008464867B2

(12) United States Patent
Holloway et al.

(10) Patent No.: US 8,464,867 B2
(45) Date of Patent: Jun. 18, 2013

(54) PACKAGE FOR TOBACCO-RELATED ARTICLES

(75) Inventors: Steve Holloway, Slough (GB); Tim Collins, London (GB); Solvey Knorr, Hamburg (DE); Neil Southey, Slough (GB); Paul Jenkins, Slough (GB); Alistair Buckingham, Slough (GB); Regine Wolfgramm, Hamburg (DE); Inga Gurke, Hamburg (DE); Slavomir Novak, Hamburg (DE); Guillaume Devivier, Cedex (FR)

(73) Assignee: Imperial Tobacco Limited, Bristol (GB)

( * ) Notice: Subject to any disclaimer, the term of this patent is extended or adjusted under 35 U.S.C. 154(b) by 0 days.

(21) Appl. No.: 13/510,772

(22) PCT Filed: Nov. 18, 2010

(86) PCT No.: PCT/EP2010/007007

§ 371 (c)(1),
(2), (4) Date: Jun. 27, 2012

(87) PCT Pub. No.: WO2011/060930

PCT Pub. Date: May 26, 2011

(65) Prior Publication Data

US 2012/0261285 A1 Oct. 18, 2012

(30) Foreign Application Priority Data

Nov. 20, 2009 (EP) ..... 09014501

(51) Int. Cl.
*B65D 85/10* (2006.01)
*B65D 5/32* (2006.01)

(52) U.S. Cl.
USPC ..... 206/250; 206/268; 206/270

(58) Field of Classification Search
USPC ..... 206/249, 250, 255, 265, 268, 270, 206/271, 273
See application file for complete search history.

(56) References Cited

U.S. PATENT DOCUMENTS 2,929,542 A 3/1960 O'Gorman
3,102,675 A * 9/1963 Schrom ..... 206/251

(Continued)

FOREIGN PATENT DOCUMENTS

EP 0183397 A2 6/1986
EP 1590251 B1 3/2009
FR 1081649 12/1954

OTHER PUBLICATIONS

Written Opinion and Search Report for counterpart Singapore Application No. 201203081-3 entitled Package for Tobacco-Related Articles (Dated Dec. 11, 2012) (issued by Danish Patent and Trademark Office).

*Primary Examiner* — Jacob K Ackun
(74) *Attorney, Agent, or Firm* — Hovey Williams LLP

(57) ABSTRACT

A package (1) for tobacco-related articles comprises an outer shell (2), a lid (4) which is adapted to close the top side of the outer shell (2) and can be swivelled about a hinge line, and an inner shell (6). The inner shell (6) accommodates a plurality of tobacco-related articles and can be shifted in the outer shell (2) from a retracted position to an advanced position, which enables access to the tobacco-related articles. A cutout (20) in the outer shell (2) exposes part of the inner shell (6) and enables transmitting a force onto the inner shell (6) for moving the inner shell (6). A connector (50) pushes the lid (4) into its opened state when the inner shell (6) is moved into its advanced position and pulls the lid (4) into its closed state when the inner shell (6) is moved into its retracted position.

51 Claims, 6 Drawing Sheets

Figure 1:
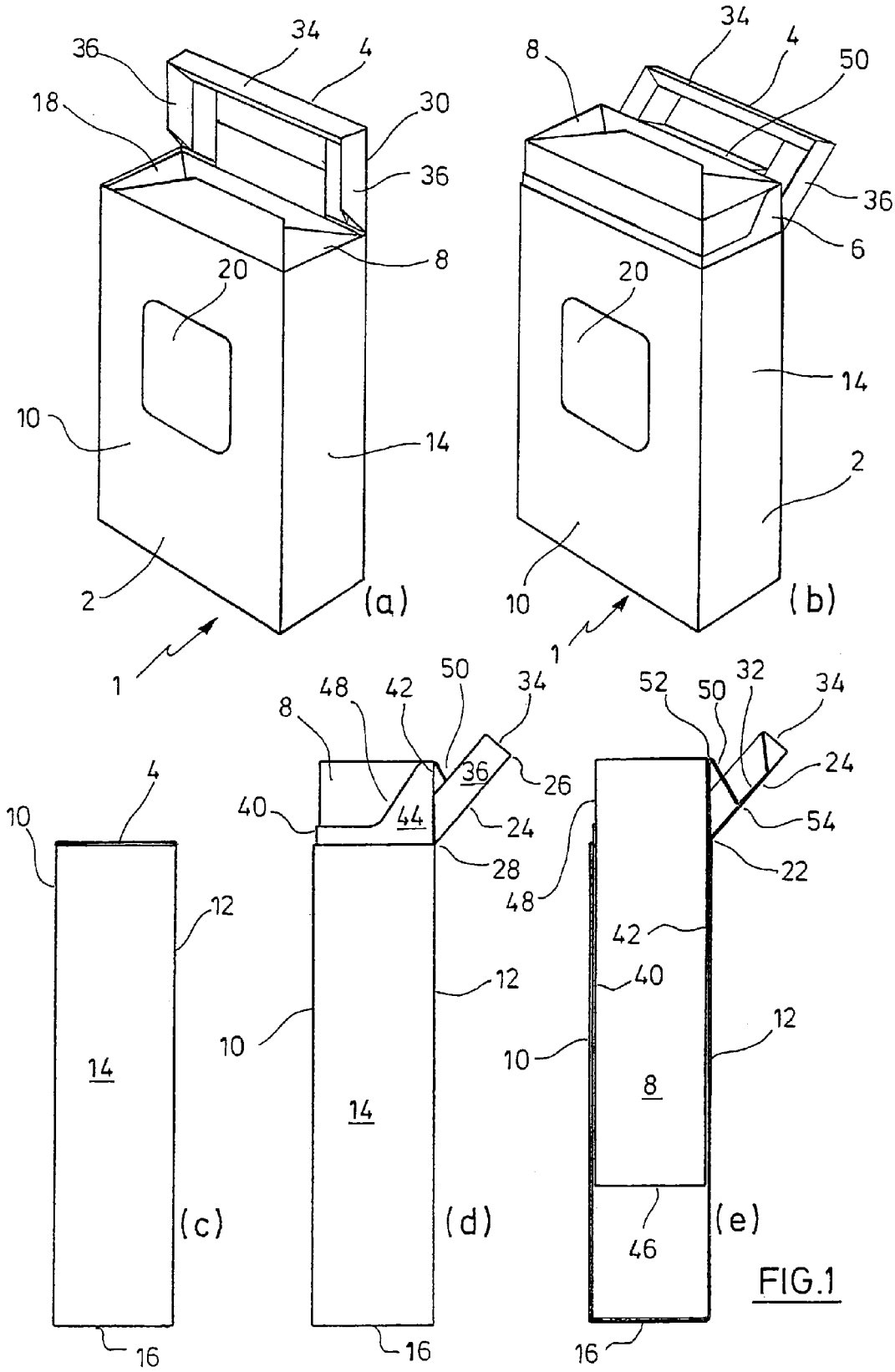

U.S. PATENT DOCUMENTS 3,311,283 A * 3/1967 Katsuji et al. ..... 229/125.08
3,589,505 A * 6/1971 Burniski ..... 206/250
4,240,548 A 12/1980 Stio
7,992,708 B2 * 8/2011 Hein et al. ..... 206/249
2005/0167299 A1 * 8/2005 Retelski ..... 206/249
2009/0205982 A1 * 8/2009 Hein et al. ..... 206/251

* cited by examiner

PACKAGE FOR TOBACCO-RELATED ARTICLES

RELATED APPLICATION

This is a National Phase Application pursuant to 35 U.S.C. §371 of International Application No. PCT/EP2010/007007, filed Nov. 18, 2010, claiming priority from European Patent Application No. EP 09014501.2, filed Nov. 20, 2009, the entire disclosures of both of which are hereby incorporated by reference herein.

BACKGROUND

The invention relates to a package for tobacco-related articles, e.g. for cigarettes or for cigarillos.

A conventional package for tobacco-related articles comprises a shell having a front wall, a rear wall, two lateral walls opposite to each other and a bottom wall connecting the front wall and the rear wall. The top side of the shell is closed by a lid, which can be opened by swivelling or rotating it about a hinge line provided at the rear wall or one of the lateral walls. For opening or closing such package, the user generally has to apply both of his or her hands.

FR 1 081 649 discloses a cigarette package comprising an outer shell and an inner shell. The inner shell accommodates the cigarettes and can be moved up and down in the outer shell by means of an actuating knob guided in a slot in the front wall of the outer shell. The top side of the outer shell is closed by two lids. When the inner shell is upwardly moved, the lids open automatically. This package can be handled by one hand. However, the means for actuating the lids are elaborate and tend to be expensive.

U.S. Pat. No. 2,929,542 describes a slide box for cigarettes in which an inner shell can be slid inside an outer shell. A lid is connected to a top edge of the inner shell by means of a flexible connector, which unlocks the lid after it has been moved out of the outer shell when the inner shell is slid in top direction. This package can be handled by one hand, but this might be inconvenient because the lid does not necessarily open automatically and it might be required to tilt the package for opening the lid.

U.S. Pat. No. 4,240,548 discloses a push pack comprising an outer shell without bottom and an inner shell. A lid opens automatically when the inner shell is moved in top direction. In order to move the inner shell, however, the user has to push it from the bottom side, which much impedes one-hand operation.

EP 1 590 251 B1 describes a rigid package for tobacco articles including an outer box and an inner box. The inner box is guided by a kind of elevator for up and down movement. This elevator consists of a flexible member surrounding the inner box in longitudinal direction and being fixed to a wall of the outer box, and it is actuated by sliding the flexible member upwards or downwards by shifting it, at the side opposite to the wall it is fixed at, through an aperture in the outer box. A lid is part of the flexible member. This package enables one-hand operation, but its design is somewhat complicated and tends to be expensive.

SUMMARY

It is the object of the invention to provide an attractive and moderate-priced package for tobacco-related articles which can be handled in a convenient way by means of one hand.

This problem is solved by a package for tobacco-related articles having the features described below.

The package according to the invention is designed to accommodate tobacco-related articles. The package comprises an outer shell having a front wall, a rear wall, two lateral walls opposite to each other and optionally a bottom wall, which connect the front wall and the rear wall, as well as a top side. A lid is adapted to close the top side of the outer shell when it is in a closed state. The lid is swivelably connected to the rear wall or one of the lateral walls of the outer shell at a hinge line, and it can be swivelled about this hinge line for transfer from the closed state to an opened state. Moreover, the package comprises an inner shell which is adapted to accommodate a plurality of tobacco-related articles. The inner shell is shiftably mounted in the outer shell and can be moved from a retracted position to an advanced position, which enables access to the smoking articles.

At least one wall of the outer shell, selected from the front wall, the rear wall or the two lateral walls, is provided with a cutout (aperture) through which part of the inner shell is exposed. By means of the cutout, a user can transmit a force onto the inner shell in order to move the inner shell, i.e. in order to shift the inner shell from its retracted to its advanced position or to move it back from its advanced to its retracted position.

A connector is provided between a portion of the inner shell and the lid. The connector engages the lid at a distance from the hinge line smaller than the dimension of the lid in a direction perpendicular to the hinge line and is adapted to push the lid into its opened state when the inner shell is moved into its advanced position and to pull the lid into its closed state when the inner shell is moved into its retracted position. Thus, the lid is automatically opened and closed, respectively, when the user moves the inner shell.

The cutout in the outer shell, in being adapted to enable transmitting a force onto the inner shell for moving the inner shell, can be adapted to enable exerting a force onto the inner shell for moving the inner shell. In this way, a user can apply his or her thumb in order to grasp through the cutout and shift the inner shell by slightly pressing onto the inner shell and moving the thumb in a direction towards the lid or away from the lid, respectively. The cutout can extend over more than one wall of the outer shell, e.g. in a corner area between the front wall and one of the lateral walls. Moreover, more than one cutout is conceivable as well. It is also possible that the bottom wall of the outer shell includes part of the cutout or an additional cutout. In alternative embodiments, an actuator for moving the inner shell is attached to the inner shell and protrudes through the cutout.

The package according to the invention can be handled in a very convenient way. In contrast to a conventional package, which the user has to hold by one hand while he or she opens the lid by the other hand, the package according to the invention can be handled or operated just by means of one hand. The user can hold it in one hand, e.g. the rear wall of the outer shell facing his or her palm, and he or she can use his or her thumb in order to grasp through the cutout and shift the inner shell by slightly pressing onto the inner shell and moving the thumb in a direction towards the lid or away from the lid, respectively (or alternatively shift the inner shell by means of the actuator mentioned above). Because of the connector, the lid opens and closes automatically. Moreover, the package according to the invention permits an attractive design, and it can be manufactured to a moderate price.

The one-hand use of the package according to the invention is advantageous in many situations, for example while driving, when operating a computer, when talking on the phone, etc., or, generally, when the user has ready one hand only and wants to take a tobacco-related article. The package can rest well in the user's hand, and the one-hand use of the package is fast and convenient.

The connector can be designed as a hinged connector, which includes at least one hinge, e.g. a hinge line at which a generally flat connector is swivelably connected to the lid or the inner shell. A hinged connector can also be formed, e.g., from metal (e.g. designed as a wire) or from plastic. However, it is conceivable as well that the connector does not comprise a hinge or hinges, e.g. a connector made from a flexible material and non-swivelably fixed to the lid and the inner shell so that the connector elastically bends when the lid opens or closes.

The inner shell, in its retracted position, can be housed inside the outer shell. However, the outer shell can also be designed as a less comprehensive structure so that the outer shell and the lid, when closed, do not fully enclose the inner shell in its retracted position. In an example of the latter design, part of the inner shell protrudes at the bottom end of the outer shell when the lid is closed.

In advantageous embodiments of the invention, the lid comprises a top wall having a front edge, a rear edge, two lateral edges and a bottom side. The top wall of the lid closes the top side of the outer shell when the lid is in its closed state, wherein the hinge line of the lid is located at the rear edge or at one of the lateral edges of the top wall. Since the hinge line of the lid is essentially at the same level as the top wall of the lid (when it is closed), the connector can be designed in a simple and reliable manner. Moreover, this geometrical and technical feature permits attractive design aspects.

In an advantageous design of the connector, the inner shell comprises a rear wall or a lateral wall having an upper edge, wherein the connector extends from this upper edge and includes a first hinge line at or in the area of this upper edge and a second hinge line at the bottom side of the top wall. Preferably, the distance between the first hinge line and the second hinge line of the connector is greater than the distance between the hinge line of the lid and the second hinge line of the connector, e.g. greater by an amount in the range of from 0.4 mm to 1.8 mm, or by an amount of about 0.7 mm. It will become evident from the embodiments described in more detail below that this condition permits a space-saving, reliable and smooth coupling between the inner shell and the lid.

Another advantageous geometrical condition for a reliable operation of the lid is that, in the closed state of the lid, the ratio of the distance between the first hinge line of the connector and the hinge line of the lid to the distance between the hinge line of the lid and the second hinge line of the connector is in the range from 0.5 to 1.0, preferably in the range from 0.70 to 0.85, e.g. about 0.78. Again, this condition will become evident from the embodiments described in detail further below.

When the hinge line of the lid is located at the rear edge or at one of the lateral edges of the top wall, a bevelled edge wall can extend from at least the edge of the top wall opposite to the hinge line of the lid. The bevelled edge wall is shaped in a sloped or curved manner such that it does not interfere with the outer shell walls during the closing process of the lid and such that it fits into the outer shell when the lid is in its closed state. Thus, it facilitates the closing process by guiding the lid into the top side space of the outer shell, stabilises the package when it is closed, and provides a better protection for the contents of the package. The bevelled edge wall can also extend from other edges of the top wall different from the edge comprising the hinge line of the lid. A lid designed in this way can look essentially flat when it is closed, which imparts to the package an interesting and attractive appearance.

In advantageous versions, the bevelled edge wall is folded from a blank of the outer shell comprising a blank of the lid. The bevelled edge wall can have different kinds of cross-sectional shapes. A triangular shape is preferred because it can be easily folded from a blank and it is stable. Other shapes are conceivable as well, e.g. a quadrangular or a polygonal shape or a shape including at least one curved face.

In other embodiments of the package according to the invention, an edge wall extends from at least the edge of the top wall opposite to the hinge line of the lid. This edge wall extends generally perpendicularly with respect to the top wall of the lid and is visible when the lid is in its closed state. Thus, it is not a bevelled edge wall as described before and provides a more conventional appearance to the package.

It is also conceivable that the lid comprises an edge wall, wherein the hinge line of the lid is not located at a top wall of the lid, but is arranged at that edge wall.

The inner shell of the package can comprise a front wall providing a free access area, which facilitates the access to the contents of the inner shell when the inner shell is in its advanced position. This free access area can be designed, e.g., as a cutoff from the front wall or by means of a portion of the front wall having a lowered upper edge or by means of a front wall having generally a low upper edge. Preferably, when the inner shell is in its retracted position, the free access area of the inner shell does not overlap with the cutout of the outer shell, i.e. the free access area is not visible when the package is closed. This improves the appearance of the package.

Generally, the inner shell can comprise a front wall and a rear wall as well as two lateral walls opposite to each other and a bottom wall, which connect the front wall and the rear wall. It is also conceivable, however, that the inner shell has a lighter structure in which not all of the above-mentioned walls are designed as wall panels. In a lighter structure, an inner wrapper or a bundle wrapper can be applied for providing additional support to the contents of the package.

In advantageous embodiments of the invention, the front wall of the inner shell comprises a reinforced structure in order to improve its counteraction capabilities when the user touches this front wall, through the cutout, in order to move the inner shell. Such structure can be made from double-layer or triple-layer cardboard, e.g., using cardboard panels folded from a blank of the inner shell. It is also conceivable to apply a separate reinforcement panel which is attached to the rest of the inner shell.

Alternatively or additionally to this reinforcement structure, a reinforcement insert can be inserted into the inner shell. The reinforcement insert can be formed, e.g., as a plastic container, preferably made by injection-moulding. Such design still uses an inner shell, e.g. made from a cardboard blank, which is coupled to the lid via the connector.

It is also possible to dispense with such cardboard inner shell and to design the inner shell as a plastic container which provides the desired rigidity. In this case, at least part of the connector can be formed as part of the plastic container, but it is also conceivable to attach a connector completely formed from a blank of the lid (e.g., as part of a blank of the outer shell) to the plastic container when assembling the package.

Preferably, the cutout of the outer shell is provided in the front wall of the outer shell. This is a location which allows for a convenient use of the package. However, it is possible as well to place the cutout at a different wall or in an area which extends over two walls or to provide more than one cutout.

The cutout of the outer shell can be located in a side area of the front wall of the outer shell, i.e. not in the centre area. This is particularly advantageous when the inner shell comprises a front wall providing a free access area (see above), because in this case the cutout of the outer shell can be placed at a location where it does not overlap with the free access area of the inner shell when the inner shell is in its retracted position. Moreover, in this design, the front wall of the outer shell exhibits a large continuous area which can be used for, e.g., warning hints.

The cutout of the outer shell can be formed from a blank of the outer shell in which at least part of the blank material of the cutout area is folded back to the inner face of the outer shell. In this way, the edges of the cutout are not sharp or somewhat irregular, but they are determined by the corresponding folding lines, which tend to be smooth and provide a greater thickness of the wall area surrounding the cutout. It can be advantageous when the blank material is not folded back at the top edge of the cutout, because that edge is not seen in detail when the user holds the package in a usual way, whereas a back-folded flap at the top edge of the cutout could interfere with an unimpeded assemblage of the package.

In advantageous embodiments of the invention, the inner shell comprises, opposite to the cutout of the outer shell, a grip-enhancing surface. Such grip-enhancing surface can be presented, e.g., by means of a relief structure incorporated in the wall material of the inner shell or provided by a sticker glued to the inner shell in the area in question. Another option is a cutout structure, e.g. in a double-layer wall structure of the inner shell in which the outer layer comprises a series of cutouts whereas the inner layer folded to the outer layer is smooth. Other embodiments include a high-friction coating or rubber-like coating, either applied to a wall or wall area of the inner shell or to a sticker glued to the inner shell in the area in question. The grip-enhancing surface facilitates the operation of the package because it increases the frictional forces to, e.g., the user's thumb.

In advantageous embodiments of a package comprising an actuator for moving the inner shell, which is attached to the inner shell and protrudes through the cutout, as mentioned above, the inner shell is lockable in its retracted position, the locking being releasable by means of the actuator, wherein optionally the inner shell is biased by a spring device towards its advanced position. In this case, the cutout can comprise a slot extending in parallel to the moving direction of the inner shell as well as a widened area at the lower end of the slot, wherein part of the actuator is lockable in the widened area of the cutout and releasable by pressing the actuator. Such kind of actuator is easily accessible to the user. When the spring device is provided, the package can be opened in a simple way, e.g., just by pressing the actuator.

The outer shell can be box-shaped. It can also comprise rounded edges, wherein preferably the longitudinal edges between the front wall and both lateral walls are rounded. Another option for the shape of the outer shell is a form with a hexagonal or octagonal cross-sectional shape, wherein the lateral walls or the front wall comprise side panels folded from the rest of the respective lateral wall or from the rest of the front wall (or rear wall) along fold lines running in parallel to a longitudinal axis of the package. Such shapes provide an attractive appearance of the package, whereas additional manufacturing expenses are moderate. The shape of the inner shell can be adjusted accordingly.

In advantageous embodiments of the invention, the outer shell and/or the inner shell of the package are folded from a respective blank. The respective blank can be made from cardboard (which term includes laminated cardboard or coated cardboard) in the weight range from 180 g/m$^2$ to 290 g/m$^2$. This involves well-established techniques. Cardboard blanks can be designed in a large number of varieties. Other materials for the components of the package are conceivable as well, however, for example cardboard having a weight outside of the range indicated above or laminated materials or plastic materials.

More generally, the package can comprise, e.g., cardboard, laminated card-board, coated cardboard, plastics materials, metals, aluminium, and/or flat materials (in general) in the thickness range from 50 μm to 2000 μm. Cardboard can be specified by its weight (mass) per unit area, which may be in the range from 180 g/m$^2$ to 290 g/m$^2$. Cardboard can also be specified by its thickness, which may range from 250 μm to 500 μl as measured in accordance with International Organization for Standardization (ISO) standard number 534 (i.e., ISO 534).

Another way to specify cardboard is by means of its stiffness, which may be in the range from 5 mN to 25 mN when measured according to ISO 2493:1992(E). In short, ISO 2493 describes the determination of resistance to bending of paper and board. The results are expressed as a force acting perpendicular to a cantilever-mounted test piece of 38 mm width close to its free end at a bending length of 50 mm, when the piece bends by 15°.

There are many design options for the connector. For example, it can be folded by part of a blank of the outer shell and by part of a blank of the inner shell, wherein both parts are glued together upon assemblage of the package. Or it can be folded by part of a blank of the outer shell and glued directly to the inner shell. Or it can be folded by part of a blank of the inner shell and glued to the lid, which preferably is made from part of a blank of the outer shell. Regarding the shape of the connector, it can be relatively narrow measured in a direction along the hinge line of the lid. But it can also have the greatest or the almost greatest possible width measured in this direction. Generally, a larger width increases the rigidity of the structure. A trapezoidal shape of the connector, e.g., provides for a large extension where it is required for improving strength but also provides sloped edges which may facilitate the assemblage of the package.

In other embodiments, the connector is provided as a metal part connected to the inner shell and to the lid, or it is provided as a wire connected to the inner shell and to the lid, or it is provided as a plastic part connected to the inner shell and to the lid. For example, a connector designed as a flat flexible metal part or a flat flexible plastic part can be useful when the connector does not comprise a hinge or hinges, e.g. when the connecter is non-swivelably fixed to the lid and the inner shell of the package so that the connector elastically bends when the lid opens or closes.

Moreover, the package can comprise a noise-producing mechanisms adapted to be operated when the lid is swivelled from the closed state to the opened state and/or from the opened state to the closed state. For example, the noise-producing mechanism may comprise a tab arranged at the lid interacting with a counterpart arranged at the outer shell and/or a tab arranged at the outer shell interacting with a counterpart arranged at the lid. When the tab scratches along its counterpart during the actuation of the lid, a noise is produced, which may have an appealing effect.

The package according to the invention is not restricted to a design comprising one inner shell containing one charge or bundle of tobacco-related products only. The invention is also directed to packages including one inner shell containing more than one bundle, and it is further directed to packages including more than one inner shell. For example, the package can comprise at least two inner shells which are arranged side by side. In this case, preferably, the lid is swivelably connected to the rear wall of the outer shell. The lid can be formed from at least two separate parts, which are arranged side by side and are swivelably connected to the rear wall of the outer shell, wherein each of the separate parts of the lid is associated to one of the inner shells. The front wall of the outer shell can be provided with at least one cutout adapted to expose part of each of the inner shells and to enable transmitting or exerting a force onto each of the inner shells for moving the respective inner shell and actuating the respective part of the lid via a connector or a hinged connector. This at least one cutout can be a single cutout in an area having access to all of the inner shells, or it can include at least two cutouts, one for each inner shell.

The package according to the invention can be filled with all kinds of tobacco-related articles, for example with cigarettes, cigarillos, cigars, tobacco-containing rods, smokeless tobacco, simulated smoking devices (e.g., electronic cigarettes), inhalors without combustion of tobacco, or aroma reservoirs.

When filled with tobacco-related articles, the package can be enclosed by, e.g., a cellophane or transparent plastic (e.g., polypropylene) wrapper, which is removed or partially removed by the user before opening the package for the first time. Such kind of wrappers aid in maintaining the aroma and freshness of the tobacco-related articles and serve as a temper-evident closure.

In a different embodiment of a package for tobacco-related articles, the outer shell does not have a cutout in its front wall, rear wall or lateral walls. In this embodiment, the outer shell rather comprises a cutout in its bottom wall (including a missing-bottom). Otherwise, this embodiment can be constructed as outlined above. For advancing the inner shell, the user has to press upon its bottom (through the bottom aperture of the outer shell), while for retracting the inner shell, the user has to manually close the lid.

BRIEF DESCRIPTION OF THE DRAWING FIGURES

In the following, the invention is further explained by means of embodiments. The drawings show in FIG. 1 in parts (a) to (e) several views of a first embodiment of a package for tobacco-related articles according to the invention, i.e. in part (a) an isometric view of the package, the lid being partially opened, in part (b) an isometric view of the package, the lid being fully opened and an inner shell of the package having been moved to an advanced position, in part (c) a side view of the package, the lid being closed, in part (d) a side view of the package in the state according to part (b), and in part (e) a longitudinal section through the package in a plane containing the centre longitudinal axis, FIG. 2 in part (a) a plane view of a blank for the outer shell of the package according to FIG. 1 and in part (b) a plane view of a blank for the inner shell of the package according to FIG. 1, FIG. 3 in parts (a) to (d) several views of a second embodiment of a package for tobacco-related articles according to the invention, i.e. in part (a) an isometric view of the package, the lid being partially opened, in part (b) an isometric view of the package, the lid being fully opened and an inner shell of the package having been moved to an advanced position, in part (c) a bottom view of the package, and in part (d) a side view of the package in the state according to part (b), FIG. 4 in part (a) a plane view of a blank for the outer shell of the package according to FIG. 3 and in part (b) a plane view of a blank for the inner shell of the package according to FIG. 3, FIG. 5 in parts (a) and (b) isometric views of a third embodiment of a package according to the invention, which contains two bundles, i.e. in part (a) with the lid partially opened and in part (b) with an inner shell of the package in an advanced position and the lid being fully opened, FIG. 6 in parts (a) and (b) isometric views of a fourth embodiment of a package according to the invention, i.e. in part (a) with a two-part lid partially opened and in part (b) with two inner shells of the package in an advanced position, the two-part lid being fully opened, and FIG. 7 in parts (a) to (c) several views of a fifth embodiment of a package according to the invention, i.e. in part (a) an isometric view of the package, the lid being partially opened, in part (b) an isometric view of the package, the lid being fully opened and the inner shell of the package having been moved to an advanced position, and in part (c) a schematic longitudinal section through parts of the outer shell and the inner shell of the package, illustrating the function of an actuator.

DETAILED DESCRIPTION OF THE PREFERRED EMBODIMENTS

FIG. 1 illustrates a first embodiment of a package 1 for tobacco-related articles.

The package 1 comprises an outer shell 2, a lid 4 adapted to close the outer shell 2, and an inner shell 6, which is movable within the outer shell 2 from a retracted position, see FIG. 1(*a*), to an advanced position, see FIG. 1(*b*).

The inner shell 6 accommodates a bundle 8 of tobacco-related articles, e.g. a bundle of cigarettes. The bundle 8 is provided in a conventional manner, e.g. by wrapping a plurality of cigarettes with, e.g., an aluminium foil or aluminium-laminated paper. In the state of the package 1 shown in FIG. 1(*b*), the bundle 8 can be easily opened in order to take out a cigarette.

The outer shell 2 comprises front wall 10, a rear wall 12, two lateral walls 14 and a bottom wall 16. In the embodiment, the top side 18 provides a free cross-sectional area.

The front wall 10 includes a cutout 20, i.e. an aperture fully penetrating the front wall 10. In the embodiment, the cutout is located approximately in the centre area of the front wall 10.

The lid 4 is connected to the upper edge of the rear wall 12 via a hinge line 22 so that it can be swivelled from a closed state, see FIG. 1(*c*), to a fully opened state, see FIG. 1(*b*), FIG. 1(*d*), and FIG. 1(*e*). In the embodiment, the lid 4 comprises a top wall 24 having a front edge 26 and a rear edge 28, see FIG. 1(*d*), as well as two lateral edges 30, see FIG. 1(*a*). Its bottom side is designated by reference numeral 32, see FIG. 1(*e*). The hinge line 22 runs along the rear edge 28 of lid 4 and is designed from a fold line of the blank the outer shell is formed from.

Moreover, the lid 4 comprises a front edge wall 34 extending from front edge 26 and two lateral edge walls 36 extending from the two lateral edges 30 of the top wall 24 of lid 4. As can be seen in FIGS. 1(*a*), (*b*), (*d*) and (*e*), the edge walls and 36 have a "bevelled" shape. That means, they extend from the front edge 26 and the lateral edges 30, respectively, in a somewhat inwardly inclined manner such that the edge walls 34 and 36 can enter the interior space of the outer shell 2 when the lid 4 is closed. Consequently, the edge walls 34 and 36 are not visible when the lid 4 is closed, see FIG. 1(*c*). In other words, when the lid 4 is closed, only its top wall 24 can be seen, which imparts to the package 1 a striking design.

When the lid 4 is closed, the edge walls 34 and 36 are located inside the outer shell 2 and stabilise the package 1. In the embodiment, the edge walls 34 and 36 have a triangular cross-sectional shape, see FIG. 1(*e*), which provides for a generally large strength of the edge walls 34 and 36. Moreover, the bevelled or inclined shape of the edge walls 34, 36 facilitates the closing process of the lid 4. In variants of the embodiment according to FIG. 1, the cross-sectional shape of the edge walls is not triangular, but different, e.g. more or less rounded.

The inner shell 6 comprises a front wall 40 and a rear wall 42, see FIG. 1(*e*), two lateral walls 44, see FIG. 1(*d*), as well as a bottom wall 46, see FIG. 1(*e*). The upper edge of the front wall 40 and part of the upper edges of the lateral walls 44 are arranged below the upper edge of the rear wall 42, see FIG. 1(*b*) and FIG. 1(*d*), which provides a free access area 48 for facilitating the removal of the tobacco-related articles of bundle 8.

In the area of the cutout 20 of the outer shell 2, the front wall 40 of the inner shell 6 is coated with a grip-enhancing, high-frictional material, e.g. a rubber-like material.

The inner shell 6 is coupled to the lid 4 by means of a hinged connector 50. As shown in FIG. 1(*b*), the connector 50 extends over most of the width of package 1. FIG. 1(*e*) illustrates the details of the connector 50 and explains how it works.

In the embodiment, the connector 50 extends from the upper edge of the rear wall 42 of the inner shell 6 at a first hinge line 52. The connector 50 is attached to the bottom side 32 of the top wall 24 of lid 4 at a second hinge line 54. The connector 50 can swivel about the hinge lines 52 and 54.

Moreover, in the embodiment, the distance between the first hinge line 52 and the second hinge line 54 is greater than the distance between the second hinge line 54 and the hinge line 22 of lid 4, e.g. by an amount of about 0.7 mm.

When the lid 4 is in its closed state, see FIG. 1(*c*), a user can place the package 1 in the palm of one of his or her hands, touch the front wall 40 of the inner shell 6 through the cutout 20 in the outer shell 2 with his or her thumb and move the thumb upwards. In this way, the user shifts the inner shell 6 from its retracted position upwards until it achieves its fully advanced position. During the movement of the inner shell 6, the connector 50 opens the lid 4 by swivelling it about the hinge line 22. Since during all times of this movement, the hinge lines 22, 52 and 54 form a triangle in the plane of FIG. 1(*e*), the swivel movement of the lid 4 is well-defined.

Initially, when lid 4 is closed, the ratio of the distance between the first hinge line 52 of the connector 50 and the hinge line 22 of the lid 4 to the distance between the hinge line 22 of the lid 4 and the second hinge line 54 of the connector 50 is about 0.78, in the embodiment. This implies that, on the one hand, the lid 4 experiences a sufficient torque during the initial moments of the opening movement, whereas, on the other hand, the upper edge of the inner shell 6, i.e. the first hinge line 52, is not located too much below the hinge line 22, i.e. the connector mechanism does not waste much space in top of the inner shell 6 when the inner shell 6 assumes its retracted position.

When the user moves his or her thumb downwards, the inner shell 6 is shifted back to its retracted position, and the connector 50 pulls the lid 4 down to its closed state.

Other numerical values of the numbers presented above can be chosen as well. A person skilled in the art can optimise the geometry of the connector 50 depending on the actual dimensions of the outer shell 2 and the inner shell 6.

Figure 2:
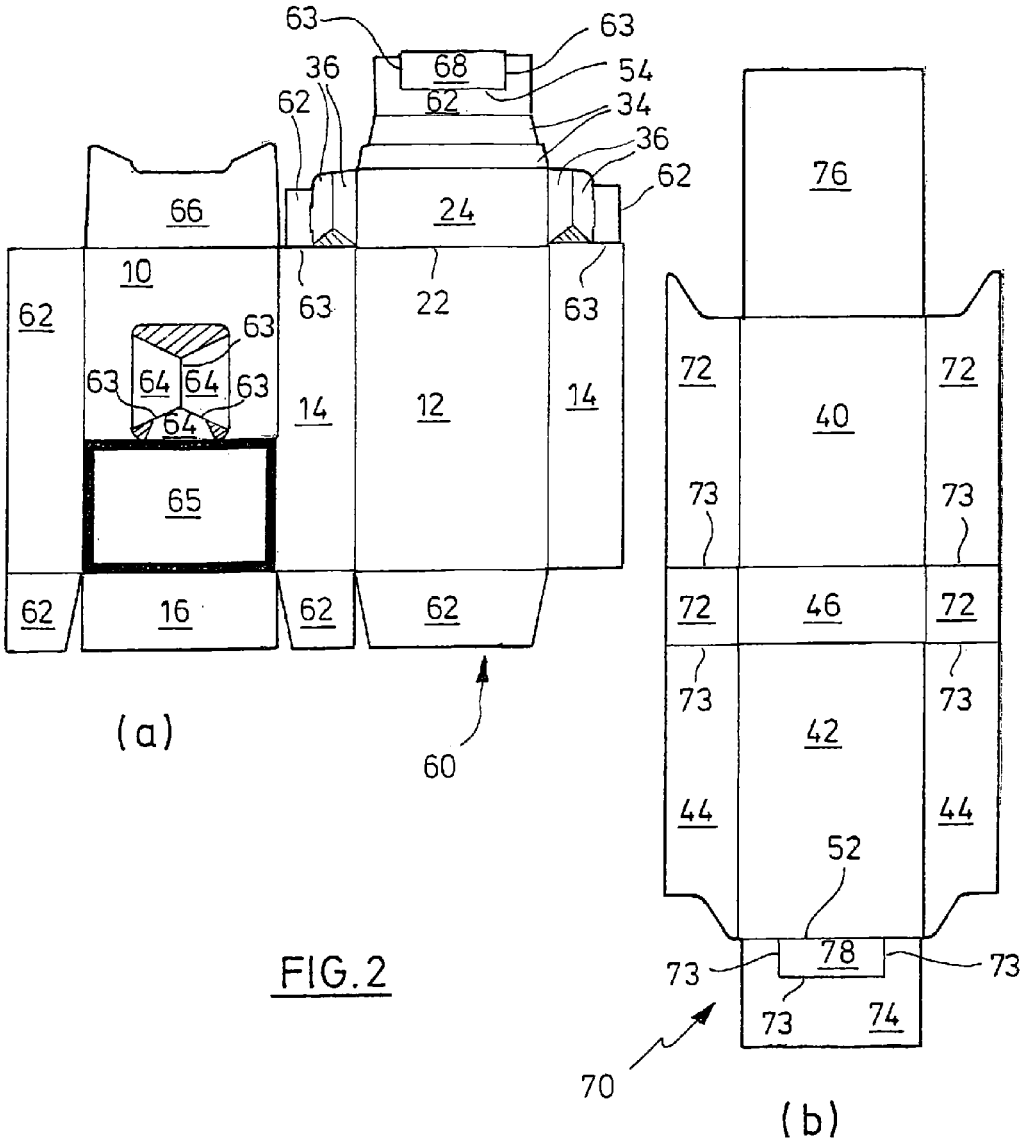

FIG. 2 illustrates a blank 60 of the outer shell 2, see FIG. 2(*a*), as well as a blank 70 of the inner shell 6, see FIG. 2(*b*). In the embodiment, both blanks are made from cardboard of a usual thickness, e.g. in the weight range from 180 g/m$^2$ to 290 g/m$^2$. Other blank materials are conceivable as well, e.g. laminated cardboard or plastic materials.

In FIG. 2(*a*), the front wall 10, the rear wall 12, the lateral walls 14, and the bottom wall 16 of the outer shell 2 are indicated by their reference numerals. Moreover, any gluing tabs are designated by reference numeral 62 and any cut-through lines by reference numeral 63. The lines not indicated by reference numerals are usual fold lines. The hatched areas are completely cut away.

In area of the cutout 20, three tabs 64 are provided which are folded back during the assemblage of the package and are glued to the inner side of the front wall 10 in order to form smooth and well-appearing edges of the cutout 20.

Reference numeral 65 indicates an area for a warning hint. The size of this area is prescribed by national regulations. In blank 60, the area 65 is located below the cutout 20.

Similar to the tabs 64, a reinforcement panel 66 is folded back during assemblage of the outer shell 2 in order to strengthen the outer shell 2 and form a well-appearing upper edge of the front wall 10.

FIG. 2(*a*) also illustrates how the lid 4 including its top wall 24 and the edge walls 34 and 36 is formed from the blank 60. The edge walls 34 and 36 are folded about their respective fold lines and are fixed to the lower side of top wall 24 by means of respective gluing tabs 62. A first part 68 of the hinged connector 50 is incorporated in the gluing tab 62 of the front edge wall 34.

The individual steps for assembling the outer shell 2 from blank 60 are evident to a person skilled in the art.

In a similar way, the blank 70 of the inner shell 6 shown in FIG. 2(*b*) comprises the front wall 40, the rear wall 42, both lateral walls 44 and the bottom wall 46 of the inner shell 6 and additionally some gluing tabs 72. Cut-through lines are indicated by reference numeral 73. Part 74 is a reinforcement part which, after having been folded and glued to the rear wall 42, stabilises the rear wall 42 and provides for a well-appearing upper edge of the rear wall 42.

A reinforcement panel 76 is folded back (and preferably glued) to the inner side of the front wall 40 in order to stabilise the front wall 40 of the inner shell 6. When the user puts his or her thumb through the cutout 20, he or she exerts some force onto the front wall 40 of the inner shell 6. As long as the bundle 8 in the inner shell 6 is still complete or almost complete, the front wall 40 of the inner shell 6 does not much yield under this pressure. During use of the package 1, however, the residual bundle 8 gets smaller and does not stabilise the inner shell 6 anymore. For this reason, the rigid front wall 40 is advantageous. In addition to reinforcement panel 76, another reinforcement panel can be used. This additional reinforcement panel can be part of the blank of the inner shell 6. A separate reinforcement panel, e.g. made from a stronger material, which is attached during the assembly process of the inner shell 6, is conceivable as well. As an alternative, the inner shell could be made completely from a sufficiently strong plastic material, e.g. as an injection-moulded part.

FIG. 2(*b*) also shows a second part 78 of the connector 50 which is cut out from the reinforcement part 74 along three cut-through lines 73.

Again, it is evident to a person skilled in the art how the inner shell 6 is assembled from blank 70.

After assemblage of the outer shell 2 and the inner shell 6 from the blanks 60 and 70, respectively, is complete, the inner shell 6 is inserted in the outer shell 2 via top side 18, and the first part 68 and the second part 78 of the connector 50 are glued together, e.g. in a position of the lid 4 as in FIG. 1(*a*).

Different designs of the connector are conceivable as well, e.g. a connector fully integrated in the blank of the outer shell or a connector fully integrated in the blank of the inner shell. Moreover, the shape of the connector can be different from that shown in FIG. 2, e.g. an even wider connector which would stabilise the package even more than the connector 50 of package 1.

Figure 3:
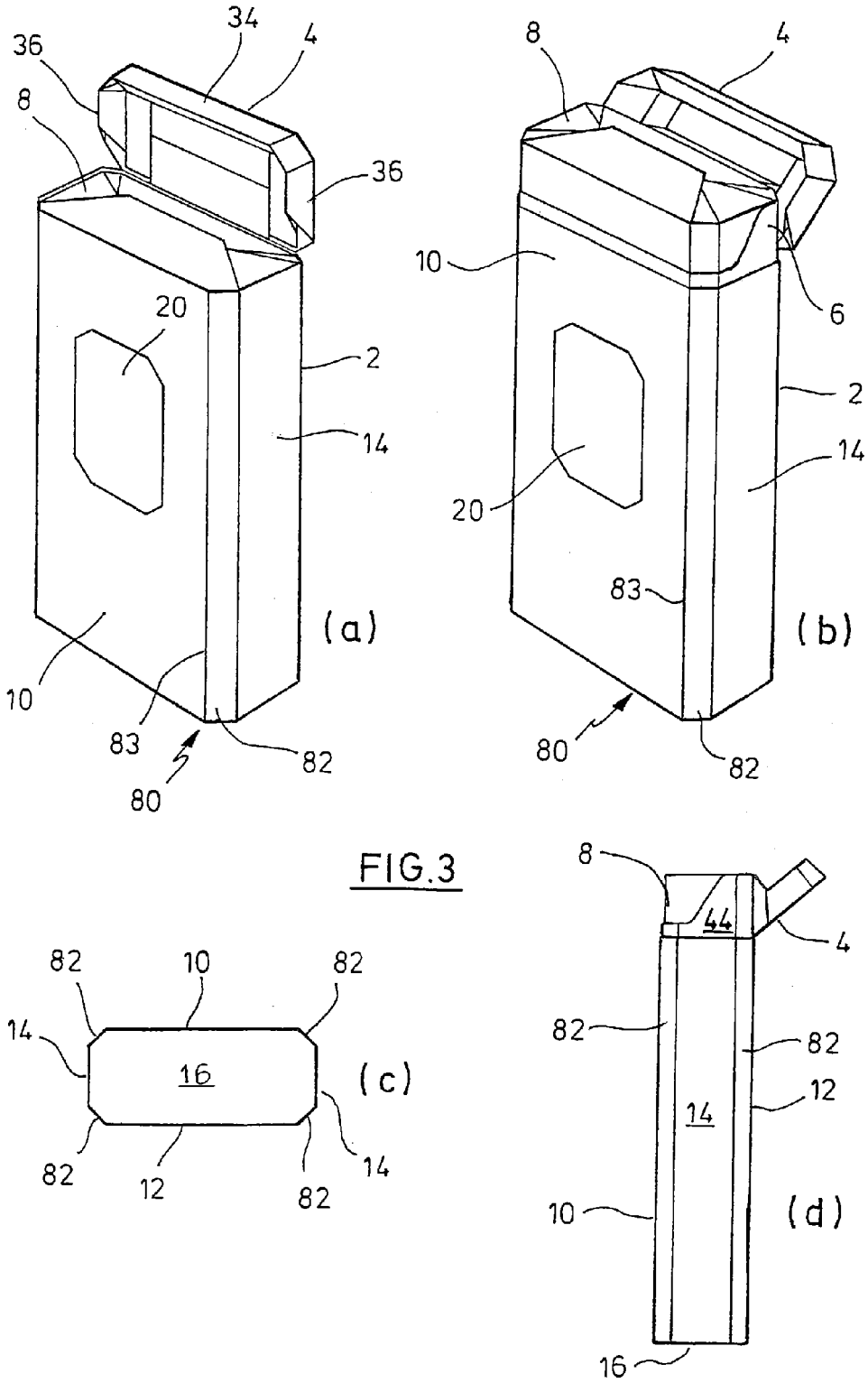

FIG. 3 illustrates another embodiment of a package for tobacco-related articles, which is designated by reference numeral 80.

The package 80 is similar to the package 1 described so far. For this reason, for most parts of package 80, the same reference numerals are used as for package 1. These parts, which include the opening mechanism of the lid 4, are not explained again.

The main difference between the packages 80 and 1 is the outer shape. In package 80, the outer shell 2 has an octagonal cross-sectional shape, see in particular the bottom view according to FIG. 3(*c*). This octagonal shape is achieved by means of side panels 82 which are folded by fold lines 83 from the front wall 10 and the rear wall 12, respectively. By definition, the side panels 82 are considered as parts of the front wall 10 and the rear wall 12, respectively, but they could be considered as parts of the lateral walls 14 as well.

Figure 4:
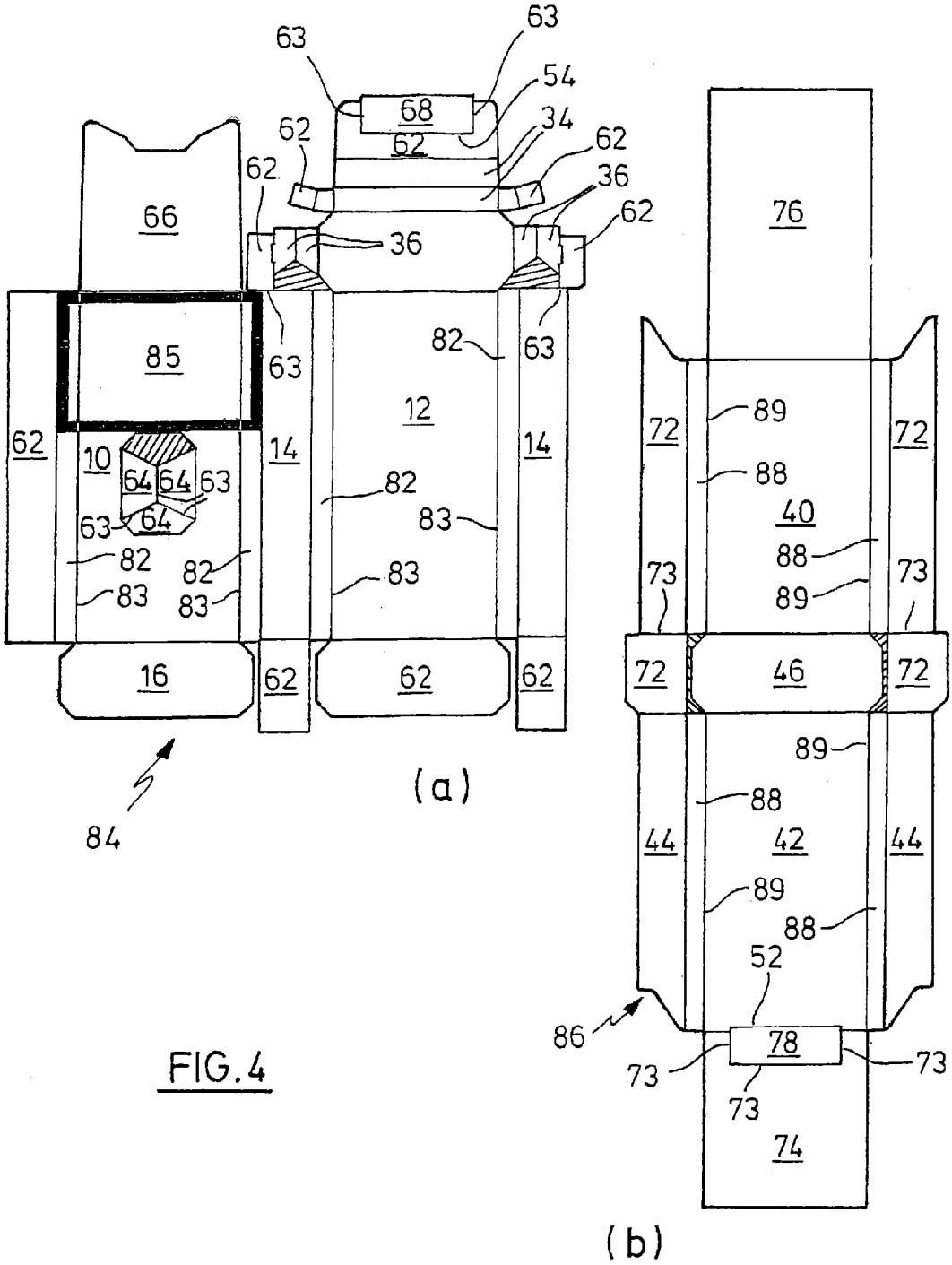

FIG. 4(*a*) shows a blank 84 for the outer shell of package 80. In this case, a warning-hint area 85 is located above the cutout of the front wall. Generally, the cutout in the front wall of the outer shell should not overlap with the free access area of the inner shell when the inner shell is in its retracted position.

A blank 86 of the inner shell of package 80 is shown in FIG. 4(*b*). The shape of the inner shell is adapted to that of the outer shell, i.e. the inner shell has an octagonal cross-sectional shape as well. In FIG. 4(*b*), the corresponding side panels and fold lines are indicated by reference numerals 88 and 89, respectively.

Otherwise, the explanation given for the assemblage of package 1 by means of the blanks 60 and 70 holds for the assemblage of the package 80 by means of the blanks 84 and 86 in an analogous manner.

Figure 5:
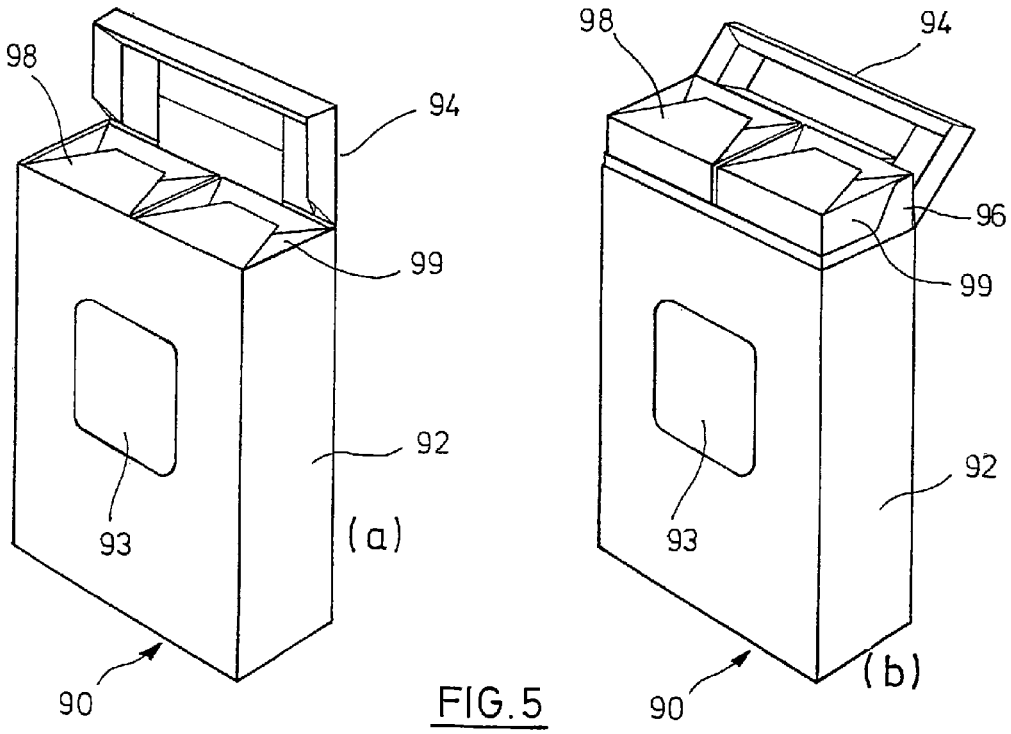

FIG. 5 illustrates a third embodiment of the package for tobacco-related articles, which is designated by reference numeral 90. In this embodiment, an outer shell 92 with a cutout 93 at its front wall can be closed at its top side by means of a swivelable lid 94. An inner shell 96 is shiftably mounted in the outer shell 92 and can be moved from a retracted position to an advanced position. The lid 94 is coupled to the inner shell 96 by means of a connector.

As before, a user can move the inner shell 96 and automatically open the lid 94 by gripping with, e.g., the thumb through the cutout 93 and sliding the inner shell 96 upwards. So far, the package 1 and the package 90 are very similar.

In contrast to package 1, however, package 90 is wider such that its inner shell 96 can accommodate two bundles 98 and 99 of tobacco-related articles, e.g. cigarettes. In practice, one bundle is consumed first, while the other one stays closed at the beginning to keep its freshness. Afterwards, the other bundle is consumed.

Figure 6:
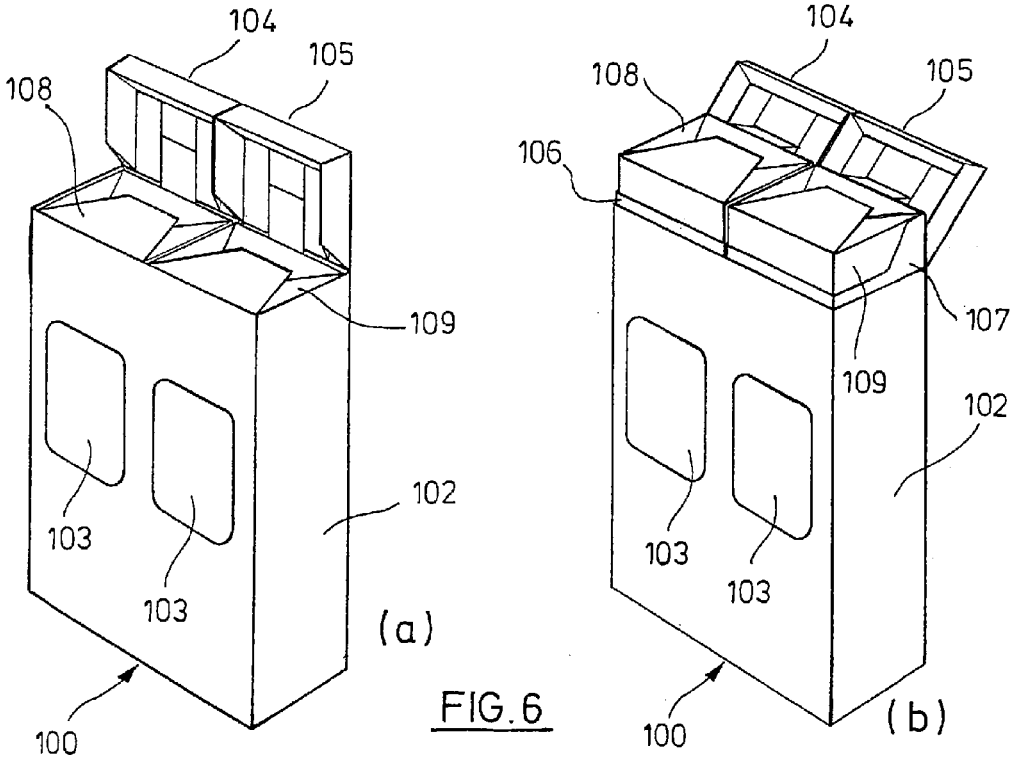

A fourth embodiment of the package for tobacco-related articles is shown in FIG. 6. This package is designated by reference numeral 100.

The package 100 comprises an outer shell 102 with two cutouts 103 in its front wall. The lid, which is swivelably connected to the upper edge of the rear wall of the outer shell 102, consists of two parts, a first part 104 and a second part 105. Both parts 104 and 105 of the lid are independent from each other.

The outer shell 102 houses two inner shells, a first inner shell 106 and a second inner shell 107. The first inner shell 106 accommodates one bundle 108 of tobacco-related articles, the second inner shell 107 one bundle 109.

The first part 104 of the lid is coupled to the first inner shell 106 by means of a connector designed as connector 50 of the embodiment according to FIG. 1. Similarly, the second part 105 of the lid is coupled to the second inner shell 107 by means of a corresponding connector. Consequently, both inner shells 106 and 107 including the parts of the lid coupled thereto, i.e. the first part 104 and the second part 105, respectively, can be moved independently from each other. In other words, the package 100 can be considered as two packages 1 arranged side by side with a common outer shell 102.

Figure 7:
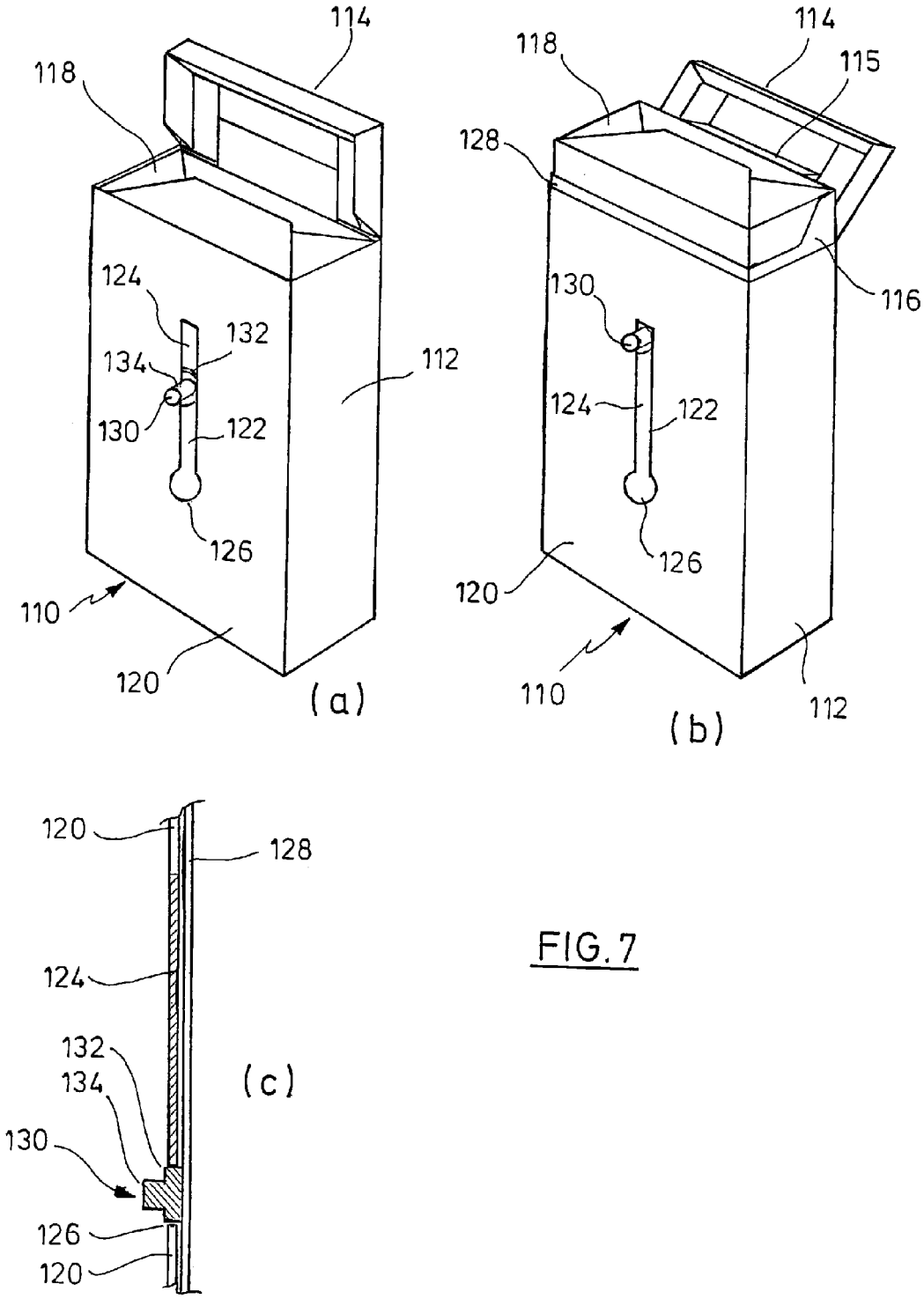

FIG. 7 illustrates a fifth embodiment of a package for tobacco-related articles, which is designated by reference numeral 110.

The design of the package 110 is very similar to that of the package 1 according to FIG. 1. However, the package 110 does not include as large a cutout as the cutout 20 of package 1.

The package 110 comprises an outer shell 112, a lid 114, which is automatically operated via a connector 115, and an inner shell 116, which can be moved from a retracted position to an advanced position. When the lid 114 is closed, the inner shell 116 is in its retracted position. FIG. 7(*a*) shows an intermediate state, when the lid 114 is partially opened. In FIG. 7(*b*), the inner shell 116 has been moved to its advanced position, and the lid 114 has been fully opened. The inner shell 116 holds a bundle 118 of cigarettes, which is still closed in the views according to FIG. 7(*a*) and FIG. 7(*b*).

The outer shell 112 has a front wall 120, which comprises a cutout 122 shaped as a slot 124 extending in parallel to the moving direction of the inner shell 116 plus an essentially circular widened area 126 at the lower end of the slot 124.

FIG. 7(*c*) shows a schematic longitudinal section through parts of the outer shell 112 and the inner shell 116. The inner shell 116 comprises a front wall 128, at which an actuator 130 is attached. In the embodiment, the actuator 130 has a cylindrical symmetry, includes a base 132 having a large diameter and a protrusion 134 having a small diameter, and is made from plastic material. The base 132 just fits into the widened area 126, whereas the protrusion 134 emerging from the base 132 can slide along the slot 124.

When the inner shell 116 is in its retracted position and the lid 114 is closed, the base 132 of the actuator 130 rests in the widened area 126 because the actuator 130 is biased by the essentially elastic action of the inner shell 116 towards the left side, in the view of FIG. 7(*c*). In this state, the base 132 locks the actuator 130, the inner shell 116 connected to the actuator 130, and the lid 114 connected to the inner shell 116. Now, when the user presses onto the protrusion 134, i.e. exerts a force directed to the right side in the view of FIG. 7(*c*), the base 132 is released from the widened area 126, and the protrusion 134 enters the slot 124. Thereafter, the user can easily move the protrusion 134 in the upward direction, thus advancing the inner shell 116 and opening the lid 114. FIG. 7(*a*) shows an intermediate position and FIG. 7(*b*) the fully advanced position of the inner shell 116.

In order to close the package 110, the user moves the protrusion 134 in the downward direction, until the base 132 locks in the widened area 126 of the cutout 122.

In a modification of the package 110, the cutout 122 additionally comprises a widened area at the upper end of the slot 124 so that the actuator 130 also locks the inner shell 116 in its advanced position.

In another modification of the package 110, the inner shell 116 is biased to its advanced position by means of a spring provided between a bottom of the outer shell 112 and a bottom of the inner shell 116. To open this package, the user presses the protrusion 134 in order to release the base 132 from the widened area 126, and immediately afterwards the spring moves the inner shell 116 to its advanced position. To close the package, the user shifts the actuator 130 in the downward direction, against the spring force, until the base 132 locks in the widened area 126.

The invention claimed is:

1. A package for tobacco-related articles, said package comprising:

an outer shell including an outer front wall, an outer rear wall, and two outer lateral walls opposite to each other and connecting the outer front wall and the outer rear wall, said outer shell including a top side;

a lid adapted to close the top side of the outer shell when in a closed state, said lid being swivelably connected to the outer rear wall or one of the outer lateral walls at a lid hinge line and being swivelable about the lid hinge line for transfer between the closed state and an opened state;

an inner shell adapted to accommodate a plurality of tobacco-related articles and shiftably mounted in the outer shell, wherein the inner shell is moveable from a retracted position to an advanced position that enables access to the tobacco-related articles;

a cutout in at least one wall selected from the group consisting of the outer front wall, the outer rear wall, and the two outer lateral walls, wherein the cutout is adapted to expose a part of the inner shell and to enable transmission of a force onto the inner shell for moving the inner shell; and a connector extending between a portion of the inner shell and the lid, wherein the connector engages the lid at a distance from the lid hinge line smaller than a dimension of the lid in a direction perpendicular to the lid hinge line, said connector being adapted to shift the lid into the opened state when the inner shell is moved into the advanced position and to shift the lid into the closed state when the inner shell is moved into the retracted position, wherein the lid comprises a top wall including a front edge, a rear edge, two lateral edges, and a bottom side, said lid hinge line being located at the rear edge or at one of the lateral edges of the top wall.

2. Package according to claim 1, wherein the outer shell includes an outer bottom wall, wherein the two outer lateral walls and the outer bottom wall connect the outer front wall and the outer rear wall.

3. Package according to claim 1, wherein the inner shell, in the retracted position, is housed inside the outer shell.

4. Package according to claim 1, wherein the connector is a hinged connector.

5. Package according to claim 1, wherein the inner shell comprises an inner rear wall having an upper edge or a lateral wall having an upper edge, wherein the connector extends from said upper edge such that a first connector hinge line is defined at or adjacent said upper edge, wherein a second connector hinge line is defined at the bottom side of the top wall.

6. Package according to claim 5, wherein a distance between the first connector hinge line and the second connector hinge line is greater than a distance between the lid hinge line and the second connector hinge line.

7. Package according to claim 5, wherein, in the closed state of the lid, a ratio of a distance between the first connector hinge line and the lid hinge line to a distance between the lid hinge line and the second connector hinge line is in the range from 0.5 to 1.0.

8. Package according to claim 1, wherein a beveled edge wall extends from at least a first edge of the top wall, said first edge being positioned opposite to the lid hinge line, wherein the beveled edge wall fits into the outer shell when the lid is in the closed state.

9. Package according to claim 8, wherein the beveled edge wall extends from a plurality of edges of the top wall.

10. Package according to claim 8, wherein the beveled edge wall is folded from a blank of the outer shell that includes a blank of the lid.

11. Package according to claim 1, wherein an edge wall extends from at least a first edge of the top wall, said first edge being positioned opposite to the lid hinge line, wherein the edge wall extends generally perpendicularly with respect to the top wall of the lid and is visible when the lid is in the closed state.

12. Package according to claim 1, wherein the inner shell comprises an inner front wall providing a free access area, which is adapted to facilitate access to a content of the inner shell when the inner shell is in the advanced position.

13. Package according to claim 12, wherein, when the inner shell is in the retracted position, the free access area of the inner shell does not overlap with the cutout of the outer shell.

14. Package according to claim 1, wherein the inner shell comprises an inner front wall, an inner rear wall, two inner lateral walls opposite to each other, and an inner bottom wall connecting the inner front wall and the inner rear wall.

15. Package according to claim 12, wherein the inner front wall comprises a reinforced structure.

16. Package according to claim 1, wherein a reinforcement insert is inserted into the inner shell.

17. Package according to claim 16, wherein the reinforcement insert is formed as a plastic container.

18. Package according to claim 1, wherein the inner shell is designed as a plastic container.

19. Package according to claim 1, wherein the cutout of the outer shell is provided in the outer front wall.

20. Package according to claim 19, wherein the cutout of the outer shell is located in a side area of the outer front wall.

21. Package according to claim 1, wherein the cutout is adapted to enable exertion of a force onto the inner shell for moving the inner shell.

22. Package according to claim 21, wherein the cutout is formed from a blank of the outer shell in which at least part of the blank of the cutout area is folded back to an inner face of the outer shell.

23. Package according to claim 21, wherein, opposite to the cutout of the outer shell, the inner shell includes a grip-enhancing surface.

24. Package according to claim 1,
said package including an actuator for moving the inner shell,
wherein the actuator is attached to the inner shell and protrudes through the cutout.
25. Package according to claim 24,
wherein the inner shell is lockable in the retracted position and releasable by means of the actuator.
26. Package according to claim 25,
wherein the cutout comprises a slot extending in parallel to a moving direction of the inner shell, as well as a widened area at a lower end of the slot,
wherein a part of the actuator is lockable in the widened area of the cutout and releasable by pressing the actuator.
27. Package according to claim 1,
wherein the outer shell comprises a plurality of rounded edges.
28. Package according to claim 1,
wherein the outer shell is hexagonal or octagonal in cross-sectional shape,
wherein a plurality of side panels are folded from the outer lateral walls or from the outer front wall along a corresponding plurality of fold lines running in parallel to a longitudinal axis of the package.
29. Package according to claim 1,
wherein at least one of the outer shell and the inner shell is folded from a respective blank.
30. Package according to claim 29,
wherein the blank is made from cardboard in a weight range from 180 g/m2 to 290 g/m2.
31. Package according to claim 1,
wherein the package comprises a material selected from the group consisting of cardboard, laminated cardboard, coated cardboard, cardboard in a weight range from 180 g/m2 to 290 g/m2, cardboard in a thickness range from 250 μm to 500 μm, cardboard in a stiffness range from 5 mN to 25 mN, flat material in a thickness range from 50 μm to 2000 μm, plastics materials, metals, and aluminum.
32. Package according to claim 1,
wherein the connector is formed in a manner selected from the group consisting of folded by a part of a blank of the outer shell and by a part of a blank of the inner shell and both parts being glued together, folded by a part of a blank of the outer shell and glued to the inner shell, folded by a part of a blank of the inner shell and glued to the lid, provided as a metal part connected to the inner shell and to the lid, provided as a wire connected to the inner shell and to the lid, and provided as a plastic part connected to the inner shell and to the lid.
33. Package according to claim 1,
wherein the package includes a noise-producing mechanism adapted to be operated when the lid is swivelled in at least a manner selected from the group consisting of from the closed state to the opened state and from the opened state to the closed state.
34. Package according to claim 1,
wherein the package includes at least two inner shells which are arranged side by side.
35. Package according to claim 34,
wherein the lid is swivelably connected to the outer rear wall.
36. Package according to claim 35,
wherein the lid is foamed from at least two separate lid parts, which are arranged side by side and are swivelably connected to the outer rear wall,
wherein each of the separate lid parts is associated with a corresponding one of the inner shells.
37. Package according to claim 36,
wherein the front wall of the outer shell is provided with at least one cutout adapted to expose a part of each of the inner shells and to enable transmission or exertion of a force onto each of the inner shells for moving a respective one of the inner shells and actuating a respective part of the lid via a connector or hinged connector.
38. Package according to claim 1,
wherein the package contains tobacco-related articles,
wherein the tobacco-related articles are selected from the group consisting of cigarettes, cigarillos, cigars, tobacco-containing rods, smokeless tobacco, simulated smoking devices, inhalors without combustion of tobacco, and aroma reservoirs.
39. Package according to claim 6,
wherein the distance between the first connector hinge line and the second connector hinge line is greater than the distance between the lid hinge line and the second connector hinge line by an amount in a range from 0.4 mm to 1.8 mm.
40. Package according to claim 39,
wherein the amount is about 0.7 mm.
41. Package according to claim 7,
wherein the ratio of the distance between the first connector hinge line and the lid hinge line to the distance between the lid hinge line and the second connector hinge line is in the range from 0.70 to 0.85.
42. Package according to claim 41,
wherein the ratio of the distance between the first connector hinge line and the lid hinge line to the distance between the lid hinge line and the second connector hinge line is about 0.78.
43. Package according to claim 10,
wherein the beveled edge wall has a cross-sectional shape selected from the group consisting of triangular, quadrangular, polygonal, and shape including at least one curved face.
44. Package according to claim 15,
wherein the reinforced structure comprises cardboard selected from the group consisting of double-layer cardboard and triple-layer cardboard.
45. Package according to claim 17,
wherein the plastic container is formed by injection molding.
46. Package according to claim 18,
wherein at least part of the connector is formed as part of the plastic container.
47. Package according to claim 20,
wherein the inner shell comprises an inner front wall providing a free access area which does not overlap with the cutout of the outer shell when the inner shell is in the retracted position.
48. Package according to claim 23,
wherein the grip-enhancing surface includes at least one feature selected from the group consisting of relief structure, cutout structure, high-friction coating, and rubber-like coating.
49. Package according to claim 25,
wherein the inner shell is biased by a spring device toward the advanced position.
50. Package according to claim 27,
wherein a first longitudinal edge between the outer front wall and a first one of the outer lateral walls is rounded, wherein a second longitudinal edge between the outer front wall and a second one of the outer lateral walls is rounded.

51. Package according to claim 33, wherein the noise-producing mechanism comprises at least one of a tab arranged at the lid interacting with a counterpart arranged at the outer shell and a tab arranged at the outer shell interacting with a counterpart arranged at the lid.

* * * * *